US005131219A

United States Patent [19]

Brockmanns et al.

[11] Patent Number: 5,131,219

[45] Date of Patent: Jul. 21, 1992

[54] SPINNING MACHINE HAVING YARN CARRIERS RETAINED IN PAIRS ON A REVOLVER

[75] Inventors: Karl-Josef Brockmanns, Willich; Heinz-Georg Wassenhoven, Mönchengladbach, both of Fed. Rep. of Germany

[73] Assignee: W. Schlafhorst AG & Co., Mönchengladbach, Fed. Rep. of Germany

[21] Appl. No.: 580,331

[22] Filed: Sep. 10, 1990

[30] Foreign Application Priority Data

Sep. 8, 1989 [DE] Fed. Rep. of Germany ..... 3929884

[51] Int. Cl.[5] ..... D01H 9/14

[52] U.S. Cl. ..... 57/276

[58] Field of Search ..... 57/266, 269, 270, 276, 57/277, 278, 279, 281, 299

[56] References Cited

U.S. PATENT DOCUMENTS

| | | | |
|---|---|---|---|
| 1,367,893 | 2/1921 | Rittenhouse | 57/276 |
| 1,670,580 | 5/1928 | Kerwin, Jr. | 57/266 |
| 2,511,928 | 6/1950 | Mansfield et al. | 57/276 |
| 2,822,662 | 2/1958 | Farrady | 57/279 |
| 3,067,567 | 12/1962 | Baer | 57/276 X |
| 3,380,238 | 4/1968 | Araki et al. | 57/276 X |
| 3,391,527 | 7/1968 | Kenjyu . | |
| 3,456,435 | 7/1969 | Hayman | 57/279 |
| 3,778,996 | 12/1973 | Olson et al. | 57/278 X |
| 3,813,864 | 6/1974 | Cochran | 57/279 |
| 3,948,029 | 4/1976 | Bridle et al. | 57/278 X |
| 4,617,791 | 10/1986 | Lousberg | 57/278 X |

FOREIGN PATENT DOCUMENTS 462247 7/1928 Fed. Rep. of Germany .

*Primary Examiner*—Daniel P. Stodola
*Assistant Examiner*—John Rollins
*Attorney, Agent, or Firm*—Herbert L. Lerner; Laurence A. Greenberg

[57] ABSTRACT

A spinning machine for ring, hopper or cap spinning with a revolver, yarn carriers retained in pairs on the revolver, and a ring traveler, hopper or cap system with a spinning ring, hopper or cap for the yarn carriers. One yarn carrier of a pair of yarn carriers having a finished cop in a spinning position is released from a ring traveler, hopper or cap system after the end of a spinning cycle. The finished cop is rotated through 180° about the axis of the revolver for moving the one yarn carrier of the pair of yarn carriers to a doffing position while moving the other yarn carrier of the pair of yarn carriers to the spinning position and spinning yarn onto the other yarn carrier. The ring traveler, hopper or cap system is mounted on the other yarn carrier once the spinning position is reached. Yarn travel from the one yarn carrier in the doffing position to the spinning ring, hopper or cap is maintained. The yarn in the vicinity of the bottom end of the yarn carrier is moved approximately radially toward the axis of the yarn carrier into an approach position. The yarn is grasped in the approach position with the yarn carrier being set into rotation. The yarn is carried along about the yarn carrier for piecing.

14 Claims, 3 Drawing Sheets

Fig. 6
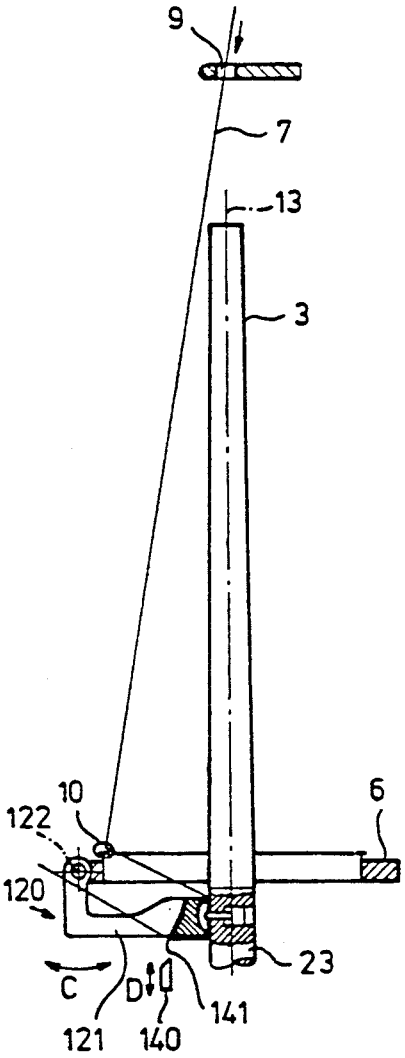
Fig. 6A
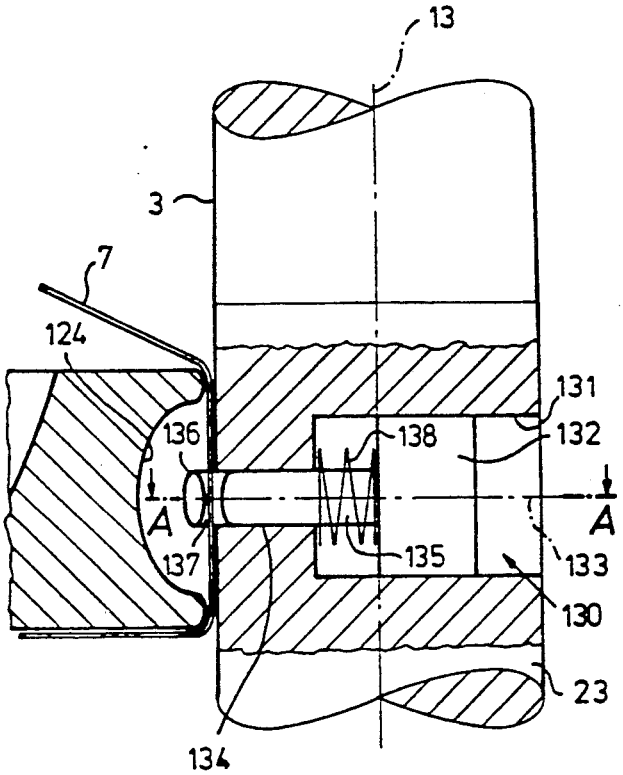
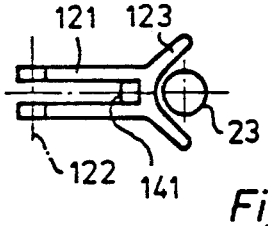
Fig. 7
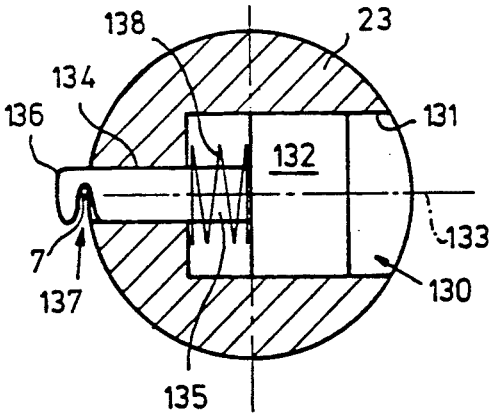
Fig. 7A

SPINNING MACHINE HAVING YARN CARRIERS RETAINED IN PAIRS ON A REVOLVER

The invention relates to a method for ring spinning, hopper spinning, or cap spinning with yarn carriers retained in pairs on a revolver, wherein one yarn carrier disposed in a spinning position after the end of a spinning cycle is released by a ring traveler, hopper or cap system; a finished cop is rotated by 180° about the axis of the revolver; and the other yarn carrier of a pair of yarn carriers is moved to the spinning position and yarn is spun thereon. The invention also relates to a spinning machine for performing the method, having a spindle rail on which a number of revolvers are rotatably supported about respective revolver pivot axes, spindles being retained in pairs on the revolvers and movable out of a spinning position into a doffing position, and a ring traveler, hopper or cap system being movable back and forth in the direction of the spindle axes in the spinning position.

A method and a machine of this generic type are known, for instance, from U.S. Pat. No. 3,391,527. Using revolvers for changing spindles from the spinning position to an unwinding or doffing position, and vice versa, makes it possible to dispense with labor-intensive doffing and transport operations. The operations of receiving the yarn and piecing it to the new yarn carrier in the spinning position are part of the process if the change of yarn carriers is to be incorporated into continuous, and particularly automatic, spinning machine operation. Previously, these steps in the method were not feasible at reasonable expense.

It is accordingly an object of the invention to provide a spinning method and spinning machine, which overcome the hereinafore-mentioned disadvantages of the heretofore-known methods and devices of this general type and to do so in such a way that simple, reliable yarn takeup is made possible, particularly for piecing the yarn after a change of yarn carriers.

With the foregoing and other objects in view there is provided, in accordance with the invention, a method for ring, hopper or cap spinning with a revolver, yarn carriers retained in pairs on the revolver, and a ring traveler, hopper or cap system with a spinning ring, hopper or cap for the yarn carriers, which comprises releasing one yarn carrier of a pair of yarn carriers having a finished cop in a spinning position from a ring traveler, hopper or cap system after the end of a spinning cycle, rotating the finished cop through 180° about the axis of the revolver for moving the one yarn carrier of the pair of yarn carriers to a doffing position while moving the other yarn carrier of the pair of yarn carriers to the spinning position and spinning yarn onto the other yarn carrier, mounting the ring traveler, hopper or cap system on the other yarn carrier once the spinning position is reached, maintaining yarn travel from the one (changed or old) yarn carrier now in the doffing position to the spinning ring, hopper or cap, moving the yarn in the vicinity of the bottom end of the yarn carrier approximately radially toward the axis of the yarn carrier into an approach position, grasping the yarn in the approach position with the yarn carrier being set into rotation, and carrying along the yarn about the yarn carrier for piecing.

The spinning machine according to the invention is distinguished by the fact that a yarn transfer device, which is provided in the space between the two spindles of a pair of spindles, takes up the yarn from the spindle that has changed to the doffing position and positions it approximately radially toward the bottom position of the spindle located in the spinning position, and that an entraining device is rotationally coupled to each spindle and is disposed on the spindle base in such a way that it grasps a yarn presented or delivered to the spindle by the transfer device and entrains it on the periphery of the spindle upon spindle rotation.

An advantage of the invention is that the yarn is readied for piecing in the vicinity of the periphery of the spindle immediately upon startup of the spindle and resumption of spinning. This is performed with the aid of the yarn transfer device, which intervenes in the yarn travel from the finished cop that is in the doffing position to the spinning ring, and presses the yarn against the base region of the spindle, or presents or delivers it sufficiently close to the base region. Upon the first startup rotation, the yarn is already taken up and carried along for piecing. As a result, both the takeup of the yarn and the piecing are incorporated in the spindle startup process, without significant time delays in the spinning cycles.

In accordance with another mode of the invention, there is provided a method which comprises grasping the yarn with the yarn carrier at a given grasping location of the yarn, and subsequently severing the yarn between the one yarn carrier in the doffing position and the given grasping location. Severing the yarn after it is grasped by the entraining device is also performed practically without delay.

In accordance with a further mode of the invention, there is provided a method which comprises performing the step of severing the yarn with yarn tension forces generated at the onset of rotation about the axis of the yarn carrier.

Alternatively or additionally, however, in accordance with an added mode of the invention, there is provided a method which comprises cutting the yarn, such as with separate means disposed in the space between the two spindles. Reliable severing of the yarn between the two spindles of one pair of spindles after their change in position prevents the formation of a double end.

In accordance with an additional mode of the invention, there is provided a method which comprises radially guiding a weight toward a spinning axis in the yarn carrier for positioning the center of gravity of the weight within a limited motion play always on one side of the spinning axis, and subjecting the weight to centrifugal forces for displacing the weight and grasping and carrying along the yarn upon rotation of the yarn carrier about the spinning axis.

When used in association with a ring spinning machine, the transfer device is preferably supported on the ring rail and matches its clearance of motion. This means that the yarn transfer device is raised out of the path of motion of the spindles when the associated revolver rotates and upon the change of spindles, and does not return to the space between the spindles again until it takes up the yarn and presents it to the spindle onto which it is to be pieced. As a result, the transfer device does not impede the normal operation of changing yarn carriers.

With the objects of the invention in view, there is also provided a spinning machine, comprising a spindle rail, a number or plurality of revolvers having pivot axes about which the revolvers are rotatably supported on the spindle rail, spindles being retained in a spindle pair and movable from a spinning position into a doffing position on each respective revolver, the spindles of each of the pairs having peripheries, bases and axes and being mutually spaced apart defining a space therebetween, a ring traveler, hopper or cap system being movable back and forth along the direction of the axis of one of the spindles disposed in the spinning position, yarn transfer devices each being disposed in a respective one of the spaces for taking up a yarn from a spindle having been moved or changed into the doffing position and delivering the yarn approximately radially toward the vicinity of the base of the spindle disposed in the spinning position, and entraining devices each being rotationally coupled to a respective one of the spindles and disposed on a respective one of the spindle bases for grasping a yarn delivered to the spindle by the transfer device and entraining the yarn on the periphery of the spindle upon rotation of the spindle.

In accordance with another feature of the invention, each of the ring traveler systems has a ring rail on which a respective one of the transfer devices is supported.

In accordance with a further feature of the invention, each of the transfer devices has a lever pivotably supported on a respective one of the ring rails, the lever having a free forked end with a path of motion in a plane extending between the spindle axes of one of the pairs of spindles.

In accordance with an added feature of the invention, the forked end has a surface, particularly at the base thereof, with a channel-like recess formed therein.

In accordance with an additional feature of the invention, each of the transfer devices has a rotatably supported disk having an effective disk periphery being subdivided into at least two curve sectors.

In accordance with yet another feature of the invention, there is provided a yarn severing means each being associated with a respective pair of spindles, the severing means being operative in a region between the spindles located in the spinning position and in the doffing or winding position.

In accordance with yet a further feature of the invention, each of the entraining devices has at least one approximately tangentially opened catching claw.

In accordance with yet an added feature of the invention, the base of each spindle has a bore formed therein with an axis extending transversely to the spindle axis, a piston having a center of gravity always being disposed on one side of the spindle axis and being axially guided in the bore, and means for resiliently pre-stressing the piston into a radially inward position, each of the entraining devices has at least one yarn catcher protruding outward from the periphery of the spindle base on a side of the spindle opposite the center of gravity of the piston whenever the piston is in the radially inward position, and the yarn catcher is at least partly retractable into the spindle base by the piston.

In accordance with yet an additional feature of the invention, there is provided a piston rod being coupled with the piston for motion, the yarn catcher being disposed on the piston rod.

In accordance with again another feature of the invention, the piston rod is guided in a radial opening being formed in the spindle and opening into the bore receiving the piston.

In accordance with again a further feature of the invention, the resilient pre-stressing means are in the form of a spring with a given spring force, the piston has a mass and a spacing between the center of gravity of the piston and the spindle axis being adapted to the given spring force, for radially displacing the piston and the yarn catcher by forces of inertia counter to the given spring force and radially pulling the yarn with the yarn catcher into the spindle base when a given spindle revolution speed is attained.

In accordance with a concomitant feature of the invention, each of the entraining devices has a catching and clamping disk being joined to the spindle base, fixed against relative rotation and protruding outward beyond the periphery of the spindle.

Other features which are considered as characteristic for the invention are set forth in the appended claims.

Although the invention is illustrated and described herein as embodied in a spinning method and spinning machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

FIG. 6 is an enlarged, fragmentary, partly sectional view of an exemplary embodiment of the components involved in the yarn transfer and entrainment for the piecing process, which is modified as compared to FIG. 4;

FIG. 6A is a fragmentary, partly broken-away and further enlarged view as compared to FIG. 6, of the spindle base and part of the transfer device;

FIG. 7 is a plan view of an operative part of the yarn transfer device of the exemplary embodiment of the FIG. 6, which is constructed as a pivot lever and is seen in association with the spindle base; and FIG. 7A is a sectional view taken along line A—A of FIG. 6A, in the direction of the arrows.

Figure 3:
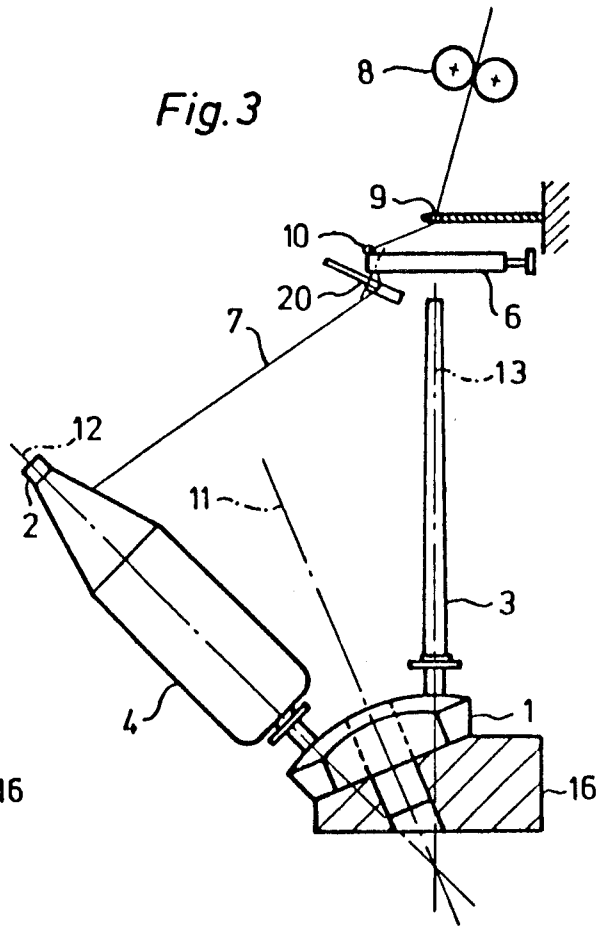
FIG. 3 shows the configuration of FIG. 2 after rotation of the revolver through 180° and a change in position of the spindles.

The invention is be described below with reference to a ring spinning and winding machine. However, the invention can also be used in hopper or cap spinning and in ring twisting machines with the same advantages, whenever a change of spindles takes place with the aid of a revolver carrying one or more pairs of spindles.

Referring now to the figures of the drawing in detail and first, particularly, to FIGS. 1–4 thereof, there is seen a ring spinning and winding machine with the components which are essential to the invention.

In the illustrated exemplary embodiment, one revolver 1 is associated with each spinning station. The revolver 1 is rotatably supported about a shaft 11 attached to a spindle rail 16 of the machine and has two spindles 2 and 3, with axes 12 and 13 which are inclined relative to the revolver shaft 11 and diverge in the direction of the free ends of the spindles.

This inclined configuration of the spindle axes makes it possible to minimize the revolver diameters and thus the space required for the entire yarn carrier changing apparatus, yet leaving relatively large free spaces for hindrance-free performance of the spinning and unreeling operations on the spindles, and for other work performed between the spindles.

Figure 1:
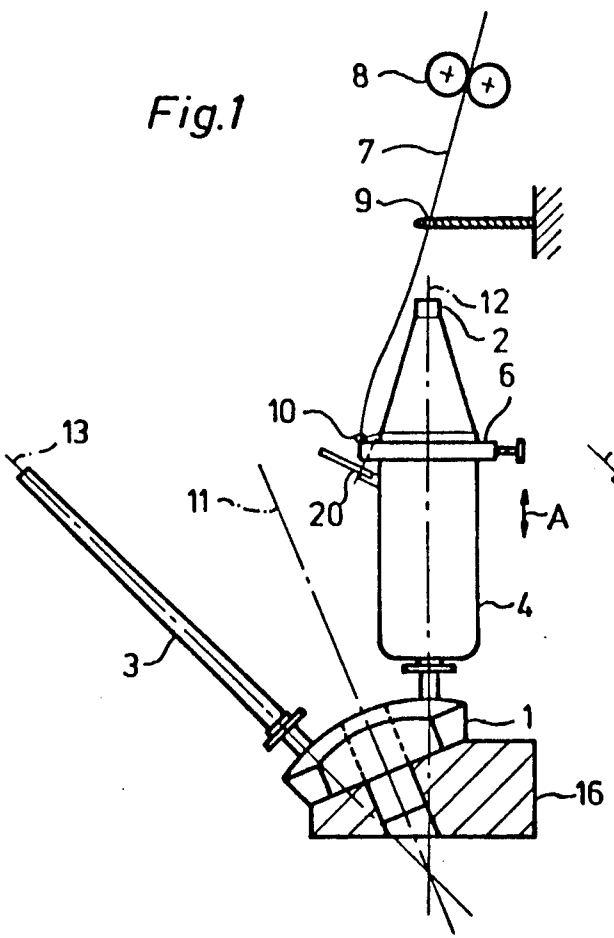
FIG. 1 is a diagrammatic, partly sectional view of a revolver for servicing a spinning station and an unreeling station, as seen in the longitudinal direction of the machine, wherein a ring traveler system is located at the level of the last spinning plane or top winding.

The spindle 2 shown in FIG. 1 is in the vertical spinning position and has a finished cop 4 disposed thereon. The cop which has had its spinning finished, is surrounded by a ring traveler system 6 at the level of the final spinning plane or top winding.

The travel of the yarn 7 from a diagrammatically indicated drawing mechanism 8 is shown in FIGS. 1–4. The yarn runs from the drawing mechanism 8 through a guide eyelet 9, through a traveler 10 of the ring traveler system 6 and onto the yarn carrier, which in this case is provided by the spindle.

Figure 2:
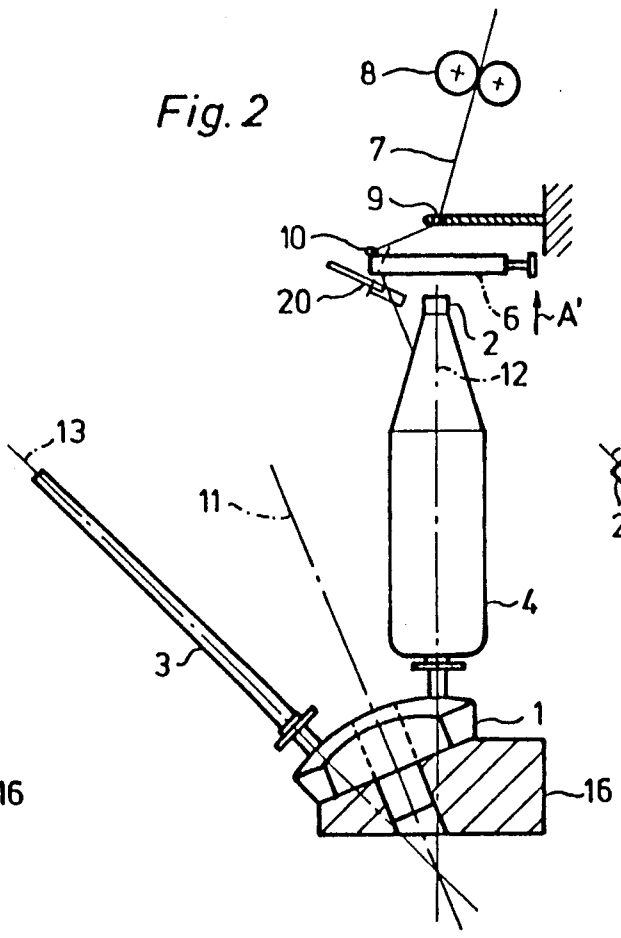
FIG. 2 shows the configuration of FIG. 1 after the ring rail has been raised past the spindle and after the release of the finished cop for spindle changing.

The ring rail of the ring traveler system 6 can be selectively raised and lowered in the direction of a double arrow A. In FIG. 2, the ring rail of the ring traveler system 6 has been raised upward far enough past the spindle 2 (in the direction of an arrow A') to permit the spindle carrying the cop 4 to move free of the ring traveler system and to be transferred to the unreeling or doffing position by rotation about the revolver shaft 11. Before the spindle change, an empty spindle 3 is in the winding or doffing position. The spindle 3 serves as the yarn carrier for the cop to be produced in the next spindle cycle. Naturally, a spinning tube may be mounted on each spindle 2, 3 as well.

Once the one spindle 2 and the other spindle 3 have been rotated by 180° about the revolver shaft 11 as seen in FIG. 3, the empty other spindle 3 changes to the spinning position, while the one spindle 2 having the finished cop 4 is transferred to the (inclined) winding or doffing position. The yarn 7 runs first from the replaced cop 4 into the traveler 10 and from there on upward through the guide eyelet 9.

Figure 4:
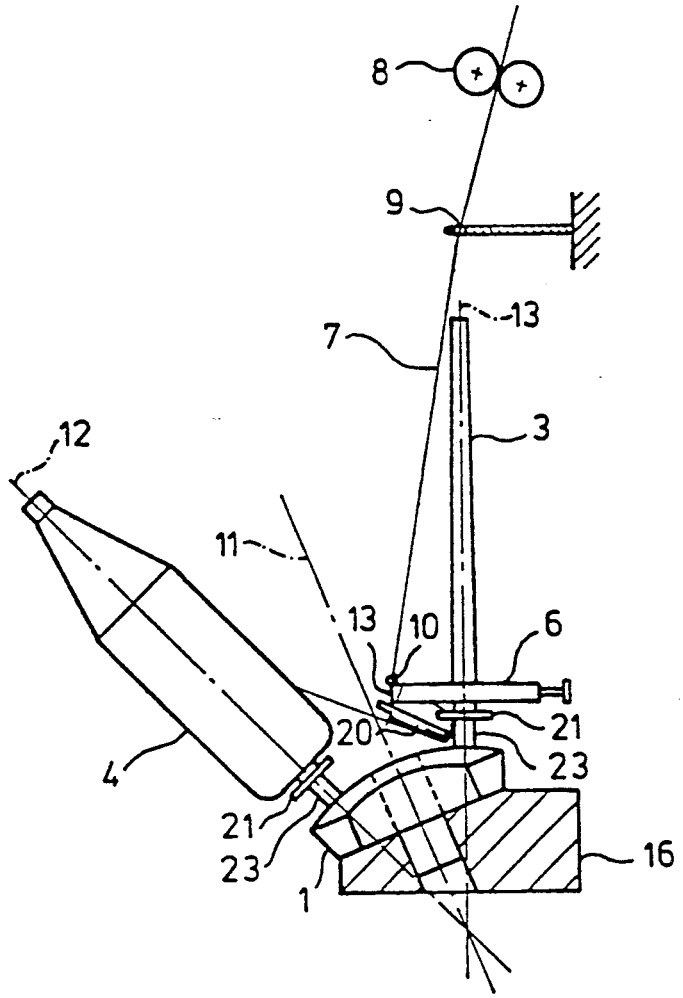
FIG. 4 shows the configuration of FIG. 3 after lowering of the ring traveler system and takeup and transfer of the yarn for the beginning of piecing.

In order to perform the next spinning cycle, the ring rail of the ring traveler system 6 is lowered axially over the spindle 3 and the yarn travel continues to be from below into the spinning ring and on through the traveler 10, and so forth, as seen in FIG. 4.

A yarn transfer device 20 is attached to the front edge 18 of the spinning rail of the ring traveler system 6, which engages the space between the spindles 2 and 3 of one pair of spindles. Before the yarn is pieced onto the spindle 3, the yarn transfer device 20 dives into the V-shaped space between the spindles 2 and 3, takes up the yarn 7, and positions it radially inwardly in the direction of the axis 13 to the spindle 3 onto which piecing is to be performed. The yarn is positioned or presented far enough to ensure that the yarn can be grasped by a catching and entraining device 21 that is connected to the spindle 3 or 2 in such a way as to be fixed against rotation relative to the spindle 3 or 2.

The catching and entraining device 21 is connected to a spindle base 23 below the portion of the spindle onto which, spinning is to be performed, in such a way as to be fixed against relative rotation.

Severing of the yarn 7 after the yarn transfer by the device 20 and grasping thereof by the catching and entraining device 21, are effected either by means of the yarn tension forces generated at the of the circumference spindle upon spindle startup after yarn entrainment, or by a suitable knife edge or other cutting device associated with either the ring traveler system 6 or the yarn transfer device 20.

Figure 4A:
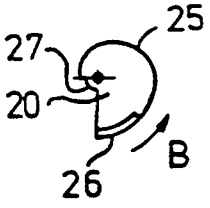
FIG. 4A is a plan view of a pressing and cutting disk, which is part of one embodiment of the yarn transfer device.

In the exemplary embodiment of FIG. 4A, the yarn transfer device is a disk 20, which is rotatable about an inclined axis and is subdivided into three sectors. These three sectors include a pressing curve 25, a cutting segment 26 and a spinning sector 27 of relatively small diameter, which serves as a gap to provide for hindrance-free travel of the yarn past it during normal spinning operation. Upon rotation of the disk 20 in the direction of an arrow B, the yarn passes through the sector 27 and is then taken up in the region of the pressing curve 25 and positioned or presented approximately radially to the base 23 of the spindle 3 onto which piecing is to be performed. After that and after the yarn has been grasped and carried along by the spinning and entraining device 21, the yarn of the cop 4 (on which spinning has been completed and which is in the winding position) is severed in the cutting zone 26, while the next spinning cycle begins.

Figure 4B:
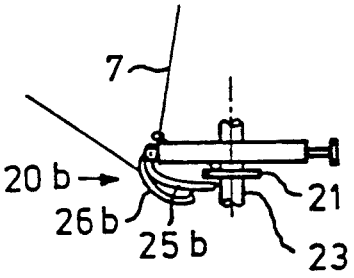
FIG. 4B is a fragmentary, elevational view of a pressing hoop, which is a component of a modified exemplary embodiment of the transfer device.

In FIG. 4B, an alternative embodiment 20*b* of the yarn transfer device is shown. In this alternative embodiment, an annular pressing hoop performs the function of transfer of the yarn 7 to the catching and entraining device 21. The pressing hoop 25*b* may be pivotably or fixedly supported on the front edge 18 of the ring rail 6. Associated with the pressing hoop 25*b*, in the embodiment of FIG. 4B, is a pivotable knife hoop 26*b*, which serves to sever the yarn 7 from the fully spun and changed cop 4.

Figure 5:
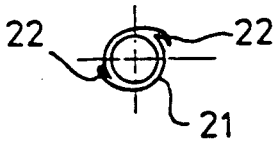
FIG. 5 is a plan view of a catching and clamping disk for entraining the yarn presented by the yarn transfer device, according to an exemplary embodiment of the invention.

In the exemplary embodiment of FIG. 5, the catching and entraining disk 21 which is shown is provided with two diametrically disposed catching claws 22, which are open at a tangent to the circumference, and which take up the yarn positioned or presented by the transfer device 20, grip it firmly and entrain it upon startup of the spindle 3. To this end, the openings of the catching claws 22 are narrowed in wedge-like fashion.

FIGS. 6 and 7 show a preferred exemplary embodiment of the yarn transfer device in cooperation with an entraining device, which is disposed at the spindle base and shown diagrammatically.

A transfer device 120 in this exemplary embodiment has a lever 121, which is is pivotably supported on the ring rail of the ring traveler system 6. The pivot axis 122 of the lever 121 extends in the lengthwise direction of the ring rail of the ring traveler system 6. A mechanism for swiveling the lever 121 in the direction of a double arrow C in FIG. 6, is not shown. A free end 123 of the lever 121 is fork-shaped as seen in FIG. 7 in such a way that it can fit over the spindle base 23, or over an entraining device built into the spindle base.

The structure of an entraining device 130 built into the spindle base 23 is best seen from the enlarged views shown in FIGS. 6A and 7A.

The spindle base 23 is provided with a radial bore 131. A piston 132 is radially guided in the radial bore 131, or in other words it is movable at right angles to the spindle axis 13. The radial bore 131 is adjoined by a coaxial opening 134, in which a weight or weighted body in the form of a rod 135 that is coupled with the piston 132 for motion is axially displaceably guided. Disposed on the outer end of the rod 135 is a yarn catcher or catching claw 136, which has a catching slit 137 that is open in the direction of rotation of the spindle 3. In the exemplary embodiment shown, a tension spring 138 is operative between the spindle base 23 and the piston 132 and seeks to retain the piston firmly in the inner position shown in FIG. 6A, or to retract it into that position.

The center of gravity of the inertia system including the piston 132 and the piston rod or yarn catcher 136 is on the right of the spindle axis 13 as seen in FIGS. 6A and 7A. Upon startup and rotation of the spindle 3, increasingly strong centrifugal forces ensue, which move the eccentrically supported piston 132, and with it the yarn catcher 136, to the right, counter to the prestressing of the spring 138. As a result, the catcher, which normally protrudes with its catching slit 137 beyond the circumference of the spindle base 23, is retracted into the spindle base or into the opening 134, and a yarn located in the catching slit 137 is firmly clamped between the claw-like yarn catcher 136 and the circumferential wall in the region of the opening 134. As a consequence, the yarn 7, which previously was positioned or presented to the circumference of the spindle in the region of the spindle base 23 by the pivoting of the yarn transfer lever 121, is firmly retained at the spindle base 23 and must match the rotation of the spindle. This assures reliable piecing.

As can be seen above all in the fragmentary, diagrammatic, sectional view of FIGS. 6A, the horizontally curved fork surface on the fork-like end 123 of the transfer lever 121 is recessed vertically with a recess 124, so that the yarn 7, in the position shown in which it is caught by the yarn catcher 136, can be taken over by the transfer lever 121 in an unimpeded manner.

FIG. 6 diagrammatically shows a cutting tool 140, below the yarn transfer lever 121, which is movable in the direction of a double arrow D and severs the yarn, for instance in cooperation with a counterpart edge 141 on the back end of the fork-like end 123, whenever the lever 121 is in the transfer position shown.

Numerous modified exemplary embodiments are possible within the scope of the invention. For instance, the transfer device 20 or 120 may be constructed as a suitable piston and cylinder configuration, which radially positions the yarn 7 to the spindle base 23 selectively, or when a lower end position of the spinning rail 6 is reached Numerous alternatives are also possible for severing the yarn or for the repiecing operation The essential factor is that after the change of spindles, the yarn 7 is taken up by the transfer device, positioned or presented approximately radially to the spindle onto which it is to be pieced, and transferred to the entraining device. Subordinate combinations and partial combinations of characteristics from various claims are also disclosed as being essential to the invention.

We claim:

1. Spinning machine, comprising a spindle rail, a plurality of revolvers having pivot axes about which said revolvers are rotatably supported on said spindle rail, spindles being retained in a spindle pair and movable from a spinning position into a doffing position on each respective revolver, said spindles of each of said pairs having peripheries, bases and axes and being mutually spaced apart defining a space therebetween, a ring traveler, hopper or cap system being movable back and forth along the direction of the axis of one of said spindles disposed in said spinning position, yarn transfer devices supported on said ring traveler, hopper or cap system and each being disposed in a respective one of said spaces for taking up a yarn from a spindle having been moved into said doffing position and delivering the yarn approximately radially toward the vicinity of the base of said spindle disposed in said spinning position, and entraining devices each being rotationally coupled to a respective one of said spindles and disposed on a respective one of said spindle bases for grasphing a yarn delivered to said spindle by said transfer device and entraining the yarn on the periphery of said spindle upon rotation of said spindle.

2. Spinning machine according to claim 1, wherein said ring traveler, hopper or cap system is a ring traveler system and said ring traveler system has a ring rail on which a respective one of said transfer devices is supported.

3. Spinning machine according to claim 2, wherein each of said transfer devices has a lever pivotably supported in a respective one of said ring rails, said lever having a free forked end with a path of motion in a plane extending between the spindle axes of one of said pairs of spindles.

4. Spinning machine according to claim 3, wherein said forked end has a surface with a channel-like recess formed therein.

5. Spinning machine according to claim 3, wherein said forked end has a base with a surface having a channel-like recess formed therein.

6. Spinning machine according to claim 2, wherein each of said transfer devices has a rotatably supported disk having an effective disk periphery being subdivided into at least two curve sectors.

7. Spinning machine according to claim 1, including yarn severing means each being associated with a respective pair of spindles, said severing means being operative in a region between said spindles located in said spinning position and in said doffing position.

8. Spinning machine according to claim 1, wherein each of said entraining devices has at least one catching claw being approximately tangentially opened with respect to the pivot axis of a respective one of said revolvers.

9. Spinning machine according to claim 1, wherein said base of each spindle has a bore formed therein with an axis extending transversely to the spindle axis, a piston having a center of gravity disposed on one side of said spindle axis and being axially guided in said bore, and means for resiliently pre-stressing said piston into a radially inward position, each of said entraining devices has at least one yarn catcher protruding outward from the periphery of said spindle base on a side of said spindle opposite the center of gravity of said piston whenever said piston is in said radially inward position, and said yarn catcher is at least partly retractable into said spindle base by said piston.

10. Spinning machine according to claim 9, including a piston rod being coupled with said piston for motion, said yarn catcher being disposed on said piston rod.

11. Spinning machine according to claim 10, wherein said piston rod is guided in a radial opening being formed in said spindle and opening into said bore receiving said piston.

12. Spinning machine according to claim 9, wherein said resilient pre-stressing means are in the form of a spring with a given spring force, said piston has a mass and a spacing between the center of gravity of said piston and the spindle axis being adapted to said given spring force, for radially displacing said piston and said yarn catcher by forces of inertia counter to said given spring force and radially pulling the yarn with said yarn catcher into said spindle base when a given spindle revolution speed is attained.

13. Spinning machine according to claim 1, wherein each of said entraining devices has a catching and clamping disk being joined to said spindle base, fixed against rotation relative to said spindle base and protruding outward beyond the periphery of said spindle for entraining the yarn.

14. Spinning machine, comprising a spindle rail, a plurality of revolvers for mounting spindles rotatably supported on said spindle rail, spindles being retained in a spindle pair and movable from a spinning position into a doffing position on each respective revolver, a ring traveler, hopper or cap system being movable back and forth along one of said spindles disposed in said spinning position, yarn transfer devices for taking up a yarn from a spindle having been moved into said doffing position and delivering the yarn toward said spindle disposed in said spinning position, and entraining devices each being rotationally coupled to a respective one of said spindles for grasping a yarn delivered to said spindle by said transfer device and entraining the yarn on said spindle upon rotation of said spindle.

* * * * *